US011751612B2

(12) United States Patent
Rykaczewski

(10) Patent No.: US 11,751,612 B2
(45) Date of Patent: Sep. 12, 2023

(54) EVAPORATIVE COOLING GARMENT

(71) Applicant: Konrad Rykaczewski, Tempe, AZ (US)

(72) Inventor: Konrad Rykaczewski, Tempe, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 17/150,334

(22) Filed: Jan. 15, 2021

(65) Prior Publication Data

US 2021/0219634 A1 Jul. 22, 2021

Related U.S. Application Data

(60) Provisional application No. 62/962,503, filed on Jan. 17, 2020.

(51) Int. Cl.

| | |
|---|---|
| ***A41D 13/005*** | (2006.01) |
| ***A41D 31/12*** | (2019.01) |
| ***A41D 31/32*** | (2019.01) |
| ***A41B 1/08*** | (2006.01) |
| ***A41D 1/06*** | (2006.01) |
| ***A42B 1/008*** | (2021.01) |

(52) U.S. Cl.

CPC ..... *A41D 13/0056* (2013.01); *A41B 1/08* (2013.01); *A41D 1/06* (2013.01); *A41D 31/12* (2019.02); *A41D 31/325* (2019.02); *A42B 1/008* (2013.01)

(58) Field of Classification Search

CPC ..... A41D 2600/10; A41D 13/002; A41D 13/0056; A41D 27/28; A63B 2071/1233

USPC ..... 2/79

See application file for complete search history.

(56) References Cited

U.S. PATENT DOCUMENTS

| | | | | |
|---|---|---|---|---|
| 6,473,910 | B2 | 11/2002 | Creagan et al. | |
| 7,730,557 | B1 | 6/2010 | Courtney et al. | |
| 9,265,654 | B2 | 2/2016 | Gallaher | |
| 10,111,480 | B2 * | 10/2018 | Pezzimenti | A41D 1/08 |
| 10,299,520 | B1 * | 5/2019 | Shaffer | A61B 5/6804 |
| 2002/0147483 | A1 | 10/2002 | Bumbarger et al. | |
| 2006/0201178 | A1 | 9/2006 | Smolko et al. | |
| 2007/0225782 | A1 | 9/2007 | Taylor | |

(Continued)

FOREIGN PATENT DOCUMENTS

WO WO 1999012436 3/1999

OTHER PUBLICATIONS

C. Mora, B. Dousset, I.R. Caldwell, F.E. Powell, R.C. Geronimo, C.R. Bielecki, C.W.W. Counsell, B.S. Dietrich, E.T. Johnston, L.V. Louis, "Global risk of deadly heat," Nat. Clim. Chang. 7 (2017) 501-506.

(Continued)

*Primary Examiner* — Sally Haden
*Assistant Examiner* — Tin Htwe Oo
(74) *Attorney, Agent, or Firm* — Fish & Richardson P.C.

(57) ABSTRACT

An evaporative cooling garment includes a first layer and a second layer superimposed over the first layer. The first layer is configured to absorb a quantity of water, and the second layer includes a reflective material and defines openings. The first layer is visible from an exterior of the garment through the openings in the second layer, and the garment defines a collapsible gap between an inner surface of the second layer and an outer surface of the first layer.

16 Claims, 4 Drawing Sheets

(56) References Cited

U.S. PATENT DOCUMENTS

| | | | | |
|---|---|---|---|---|
| 2008/0040839 | A1 | 2/2008 | Gordon | |
| 2011/0154557 | A1* | 6/2011 | Gray | D06M 13/46 2/206 |
| 2016/0338435 | A1* | 11/2016 | Aihara | A41D 1/08 |
| 2019/0365000 | A1* | 12/2019 | Simmons | A41D 31/14 |

OTHER PUBLICATIONS

S.C. Sherwood, M. Huber, "An adaptability limit to climate change due to heat stress," Proc. Natl. Acad. Sci. 107 (2010) 9552-9555.
M. Li, S. Gu, P. Bi, J. Yang, Q. Liu, "Heat waves and morbidity: current knowledge and further direction—a comprehensive literature review," Int. J. Environ. Res. Public Health 12 (2015) 5256-5283.
C. Mora, C.W.W. Counsell, C.R. Bielecki, L.V. Louis, "Twenty-seven ways a heat wave can kill you: deadly heat in the era of climate change," Circ. Cardiovasc. Qual. Outcomes. 10 (2017) e004233, 3 pages.
J.F. Reynolds, A. Grainger, D.M. Stafford Smith, G. Bastin, L. Garcia-Barrios, R.J. Fernández, M.A. Janssen, N. Jürgens, R.J. Scholes, A. Veldkamp, "Scientific concepts for an integrated analysis of desertification," L. Degrad. Dev. 22 (2011) 166-183.
J. Huang, H. Yu, X. Guan, G. Wang, R. Guo, "Accelerated dryland expansion under climate change," Nat. Clim. Chang. 6 (2016) 166-172.
F. Wang, W. Song, "An investigation of thermophysiological responses of human while using four personal cooling strategies during heatwaves," J. Therm. Biol. 70 (2017) 37-44.
W. Song, F. Wang, C. Zhang, "Intermittent wetting clothing as a cooling strategy for body heat strain alleviation of vulnerable populations during a severe heatwave incident," J. Therm. Biol. 79 (2019) 33-41.
L. Yang, H. Yan, J.C. Lam, "Thermal comfort and building energy consumption implications—a review," Appl. Energy 115 (2014) 164-173.
K. Rykaczewski, "Cool future fashion: Personal cooling as part of social adaptation to hotter climates," Temperature. 6 (2019) 97-100, https://doi.org/DOI: 10.1080/23328940.2019.1574201.
B. Givoni, H.S. Belding, "The cooling efficiency of sweat evaporation," Biometeorology, Elsevier, 1962, p. 304-314.
N. Kondo, T. Nishiyasu, H. Ikegami, "The influence of exercise intensity on sweating efficiency of the whole body in a mild thermal condition," Ergonomics 39 (1996) 225-231.
M. Guan, S. Annaheim, J. Li, M. Camenzind, A. Psikuta, R.M. Rossi, "Apparent evaporative cooling efficiency in clothing with continuous perspiration: a sweating manikin study," Int. J. Therm. Sci. 137 (2019) 446-455.
F.N. Craig, J.T. Moffitt, "Efficiency of evaporative cooling from wet clothing," J. Appl. Physiol. 36 (1974) 313-316.
M. Guan, S. Annaheim, M. Camenzind, J. Li, S. Mandal, A. Psikuta, R.M. Rossi, "Moisture transfer of the clothing—human body system during continuous sweating under radiant heat," Text. Res. J., 2019, 89(21-22):4537-4553.
G. Havenith, M.G. Richards, X. Wang, P. Brode, V. Candas, E. den Hartog, I. Holmér, K. Kuklane, H. Meinander, W. Nocker, "Apparent latent heat of evaporation from clothing: attenuation and "heat pipe" effects," J. Appl. Physiol. 104 (2008) 142-149.
G. Havenith, P. Bröde, E. den Hartog, K. Kuklane, I. Holmer, R.M. Rossi, M. Richards, B. Farnworth, X. Wang, "Evaporative cooling: effective latent heat of evaporation in relation to evaporation distance from the skin," J. Appl. Physiol. 114 (2013) 778-785.
B. Alber-Wallerström, I. Holmer, "Efficiency of sweat evaporation in unacclimatized man working in a hot humid environment," Eur. J. Appl. Physiol. Occup. Physiol. 54 (1985) 480-487.
V. Candas, J.P. Libert, J.J. Vogt, "Influence of air velocity and heat acclimation on human skin wettedness and sweating efficiency," J. Appl. Physiol. 47 (1979) 1194-1200.
S.F. Neves, J. Campos, T.S. Mayor, "Effects of clothing and fibres properties on the heat and mass transport, for different body heat/sweat releases," Appl. Therm. Eng. 117 (2017) 109-121.
F. Wang, S. Del Ferraro, L .-Y. Lin, T. Sotto Mayor, V. Molinaro, M. Ribeiro, C. Gao, K. Kuklane, I. Holmér, "Localised boundary air layer and clothing evaporative resistances for individual body segments," Ergonomics 55 (2012) 799-812.
R.M. Rossi, "High-performance sportswear," High-Performance Appar., first ed., Woodhead Publishing, 2018, p. 341-356.
L. Peng, B. Su, A. Yu, X. Jiang, "Review of clothing for thermal management with advanced materials," Cellulose, 2019, 26:6415-6448.
E. Pakdel, M. Naebe, L. Sun, X. Wang, "Advanced functional fibrous materials for enhanced thermoregulating performance," ACS Appl. Mater. Interfaces, 11 (2019) 13039-13057.
K. Fu, Z. Yang, Y. Pei, Y. Wang, B. Xu, Y. Wang, B. Yang, L. Hu, "Designing textile architectures for high energy-efficiency human body sweat- and cooling-management," Adv. Fiber Mater. 1 (2019) 61-70, https://doi.org/10.1007/s42765-019-0003-y.
Y. Zhong, F. Zhang, M. Wang, C.J. Gardner, G. Kim, Y. Liu, J. Leng, S. Jin, R. Chen, "Reversible humidity sensitive clothing for personal thermoregulation," Sci. Rep. 7 (2017) 44208, 9 pages.
J. Mu, G. Wang, H. Yan, H. Li, X. Wang, E. Gao, C. Hou, A.T.C. Pham, L. Wu, Q. Zhang, "Molecular-channel driven actuator with considerations for multiple configurations and color switching," Nat. Commun. 9 (2018) 590, 10 pages.
K. Bal, L. Hes, V. Bajzik, "Analytical model to study a new design concept for providing comfort in hot arid climate," Indian J. Fibre Text. Res. 42 (2017) 379-385.
L. Hes, K. Bal, M. Boguslawska-Baczek, "Why black clothes can provide better thermal comfort in hot climate than white clothes," Fiber Soc. Spring Conf. (Liberec, Czech Republic, May 21-23, 2014), 2 pages.
F.G. Beltrami, T. Hew-Butler, T.D. Noakes, "Drinking policies and exercise-associated hyponatraemia: is anyone still promoting overdrinking?" Br. J. Sports Med. 42 (2008) 796-801.
F.M. Bright, G.K. Chaseling, O. Jay, N.B. Morris, "Self-paced exercise performance in the heat with neck cooling, menthol application, and abdominal cooling," J. Sci. Med. Sport. 22 (2019) 371-377.
C. Sunderland, R. Stevens, B. Everson, C.J. Tyler, "Neck-cooling improves repeated sprint performance in the heat," Front. Physiol. 6 (2015) 314, 10 pages.
C.J. Tyler, C. Sunderland, "Cooling the neck region during exercise in the heat," J. Athl. Train. 46 (2011) 61-68.
M. Rother, J. Barmettler, A. Reichmuth, J.V. Araujo, C. Rytka, O. Glaied, U. Pieles, N. Bruns, Self-sealing and puncture resistant breathable membranes for water-evaporation applications, Adv. Mater. 27 (2015) 6620-6624.
M. Rothmaier, M. Weder, A. Meyer-Heim, J. Kesselring, "Design and performance of personal cooling garments based on three-layer laminates," Med. Biol. Eng. Comput. 46 (2008) 825-832.
R. Nayak, S. Kanesalingam, S. Houshyar, L. Wang, R. Padhye, A. Vijayan, "Evaluation of thermal, moisture management and sensorial comfort properties of superabsorbent polyacrylate fabrics for the next-to-skin layer in firefighters' protective clothing," Text. Res. J. 88 (2018) 1077-1088.
M.A.R. Bhuiyan, L. Wang, R.A. Shanks, J. Ding, "Polyurethane—superabsorbent polymer-coated cotton fabric for thermophysiological wear comfort," J. Mater. Sci. 54 (2019) 9267-9281.
P. Glampedaki, V. Dutschk, R. Paul, "Superabsorbent finishes for textiles," Funct. Finish. Text. Improv. Comf. Perform. Prot. (2014) 283-302.
Y. Yang, J. Stapleton, B.T. Diagne, G.P. Kenny, C.Q. Lan, "Man-portable personal cooling garment based on vacuum desiccant cooling," Appl. Therm. Eng. 47 (2012) 18-24, https://doi.org/10.1016/j.applthermaleng.2012.04.012.
Y. Yang, D. Rana, C.Q. Lan, T. Matsuura, "Development of Membrane-based Desiccant Fiber for Vacuum Desiccant Cooling," ACS Appl. Mater. Interfaces. 8 (2016) 15778-15787.
K. Rykaczewski, "Modeling thermal contact resistance at the finger-object interface," Temperature, 2019, 6(1):85-95, https://doi.org/10.1080/23328940.2018.1551706.

(56) References Cited

OTHER PUBLICATIONS

A. Psikuta, J. Frackiewicz-Kaczmarek, I. Frydrych, R. Rossi, "Quantitative evaluation of air gap thickness and contact area between body and garment," Text. Res. J., 2012, 82(14):1405-1413, https://doi.org/10.1177/0040517512436823.
J. Xu, A. Psikuta, J. Li, S. Annaheim, R.M. Rossi, "Influence of human body geometry, posture and the surrounding environment on body heat loss based on a validated numerical model," Build. Environ. 166 (2019) 106340, 13 pages.
L. Cai, A.Y. Song, P. Wu, P .-C. Hsu, Y. Peng, J. Chen, C. Liu, P.B. Catrysse, Y. Liu, A. Yang, "Warming up human body by nanoporous metallized polyethylene textile," Nat. Commun. 8 (2017) 496, 8 pages.
L. Cai, A.Y. Song, W. Li, P. Hsu, D. Lin, P.B. Catrysse, Y. Liu, Y. Peng, J. Chen, H. Wang, "Spectrally selective nanocomposite textile for outdoor personal cooling," Adv. Mater. 30 (2018) 1802152, 8 pages.
S.W. Churchill, H.H.S. Chu, "Correlating equations for laminar and turbulent free convection from a vertical plate," Int. J. Heat Mass Transf. 18 (1975) 1323-1329.
B. Gebhart, L. Pera, "The nature of vertical natural convection flows resulting from the combined buoyancy effects of thermal and mass diffusion," Int. J. Heat Mass Transf. 14 (1971) 2025-2050.
P.H. Oosthuizen, "External natural convective heat transfer from bodies having a wavy surface for conditions under which laminar, transitional, and turbulent flow can exist," Adv. Heat Transf. 48 (2016) 261-317.
P.H. Oosthuizen, "A numerical study of laminar and turbulent natural convective flow through a vertical symmetrically heated channel with wavy walls," Paper presented to the 8th International Conference on Heat Transfer, Fluid Mechanics and Thermodynamics, Pointe Aux Piments, Mauritius, Jul. 11-13, 2011, pp. 352-359.
F. Boulogne, B. Dollet, "Convective evaporation of vertical films," Soft Matter. 14 (2018) 1665-1671.
W.A. Lotens, G. Havenith, "Ventilation of rain-wear determined by a trace gas method," in: I.B. Mekjavic, E. W. Banister, J.B. Morrison (Eds.), Sustain. Hum. Perform. Harsh Environ., © Taylor and Francis, New York, 1988, 9 pages.
M.P. Morrissey, R.M. Rossi, "The effect of metallisation, porosity and thickness on the thermal resistance of two-layer fabric assemblies," J. Ind. Text. 44 (2015) 912-923.
M.P. Morrissey, R.M. Rossi, "The effect of wind, body movement and garment adjustments on the effective thermal resistance of clothing with low and high air permeability insulation," Text. Res. J. 84 (2014) 583-592.
A. Shkolnik, C.R. Taylor, V. Finch, A. Borut, "Why do Bedouins wear black robes in hot deserts?" Nature. 283 (1980) 373-375.
S .-M. Yeon, H .-E. Kim, "Effect of slit ventilation system in sportswear on physiological responses," Fash. Text. Res. J. 7 (2005) 75-80, English Abstract.
M. Zhao, C. Gao, F. Wang, K. Kuklane, I. Holmér, J. Li, "A study on local cooling of garments with ventilation fans and openings placed at different torso sites," Int. J. Ind. Ergon. 43 (2013) 232-237.
X. Wan, F. Wang, "Numerical analysis of cooling effect of hybrid cooling clothing incorporated with phase change material (PCM) packs and air ventilation fans," Int. J. Heat Mass Transf. 126 (2018) 636-648.
Y. Sun, W.J. Jasper, E.A. DenHartog, "Effects of air velocity, air gap thickness and configuration on heat transfer of a wearable convective cooling system," J. Text. Sci. Eng, 5 (2015) 227, 7 pages.
Y. Sun, W.J. Jasper, "Numerical modeling of heat and moisture transfer in a wearable convective cooling system for human comfort," Build. Environ. 93 (2015) 50-62.
A .-S. Yang, Y .-C. Shih, C .-L. Lee, M .-C. Lee, "Investigation of flow and heat transfer around internal channels of an air ventilation vest," Text. Res. J. 84 (2014) 399-410.
N. Ghaddar, K. Ghali, J. Harathani, E. Jaroudi, "Ventilation rates of micro-climate air annulus of the clothing-skin system under periodic motion," Int. J. Heat Mass Transf. 48 (2005) 3151-3166.
A. Middel, E.S. Krayenhoff, "Micrometeorological determinants of pedestrian thermal exposure during record-breaking heat in Tempe, Arizona: introducing the MaRTy observational platform," Sci. Total Environ. 687 (2019) 137-151.
W.W. Carr, D.S. Sarma, M.R. Johnson, B.T. Do, V.A. Williamson, W.A. Perkins, "Infrared absorption studies of fabrics," Text. Res. J. 67 (1997) 725-738.
T. Haran, "Short-wave infrared diffuse reflectance of textile materials," Thesis for the Degree of Master of Science, Georgia State University, College of Arts and Sciences, Nov. 2008, 82 pages.
M. Patrick Morrissey, R. Michel Rossi, "The influence of fabric air permeability on the efficacy of ventilation features," Int. J. Cloth. Sci. Technol. 25 (2013) 440-450.
H. Zhang, T.L. Hu, J.C. Zhang, "Surface emissivity of fabric in the 8-14 μ m waveband," J. Text. Inst. 100 (2009) 90-94.
J.A. Clark, K. Cena, Net radiation and heat transfer through clothing: the effects of insulation and colour, Ergonomics. 21 (1978) 691-696.
K. Rykaczewski, "Rational design of sun and wind shaded evaporative cooling vests for enhanced personal cooling in hot and dry climates," Appl. Therm. Eng. 171 (2020) 115122, 12 pages.
P.H. Oosthuizen, "A numerical study of laminar and turbulent natural convective heat transfer from an isothermal vertical plate with a wavy surface," in: ASME 2010 Int. Mech. Eng. Congr. Expo., American Society of Mechanical Engineers, 2010: pp. 1481-1486.

* cited by examiner

EVAPORATIVE COOLING GARMENT

CROSS-REFERENCE TO RELATED APPLICATION

This application claims the benefit of U.S. Patent Application No. 62/962,503 entitled "EVAPORATIVE COOLING GARMENT" and filed on Jan. 17, 2020, which is incorporated by reference herein in its entirety.

TECHNICAL FIELD

This invention relates to an evaporative cooling garment having collapsible sun and wind shading elements.

BACKGROUND

As heatwaves become more frequent and intense, personal cooling becomes increasingly important for maintaining outdoor activities and for individuals without access to air conditioning. For about one-third of the current global population living in drylands, evaporating water from clothing is the simplest, safest, most cost-effective, and lightest weight method of augmenting natural thermoregulation. To cool off, one can simply wear a water-soaked cotton shirt or a highly water-absorbing commercial cooling garment. However, of the stored water, the vast majority is wasted if such apparel is exposed to solar radiation or even slow air flow.

SUMMARY

This disclosure relates to an evaporative cooling garment having collapsible sun and wind shading elements over a surface of the garment. Geometrical and radiative properties of the shading elements are described. For a wearer who is not moving and in stagnant conditions, cooling and the water usage efficiency are optimized by introducing a ventilation gap between the garment surface and the shading elements. In contrast, for a wearer who is moving or exposed to wind, such a gap can result in excessive evaporation rates that are dependent on the wind speed. A perforated reflective second layer with a collapsible ventilation gap can provide a moderate cooling rate that is nearly independent of sun and wind effects. For a high wearer exertion rate, the evaporative garment can also provide a higher cooling rate by maintaining the gap. The evaporative cooling garment can help reduce the weight of a garment, increase its length of cooling, or both.

In a general aspect, an evaporative cooling garment includes a first layer and a second layer superimposed over the first layer. The first layer is configured to absorb a quantity of water, and the second layer includes a reflective material and defines openings. The first layer is visible from an exterior of the garment through the openings in the second layer, and the garment defines a collapsible gap between an inner surface of the second layer and an outer surface of the first layer.

Implementations of the general aspect may include one or more of the following features.

In some implementations, the openings in the second layer include about 10% to about 50% of the surface area defined by a perimeter of the second layer. The openings can be rectangular or circular. The collapsible gap, when not collapsed, is typically in a range between about 0.1 cm and about 2 cm. When the collapsible gap is collapsed, the inner surface of the second layer and the outer surface of the first layer are in direct contact.

In some implementations, the first layer is a composite material. In one example, the first layer includes a superabsorbent polymer. The first layer can include a multiplicity of layers. In some implementations, the first layer has a thickness between about 0.1 cm and about 1.5 cm. In certain implementations, the second layer has a thickness between about 0.1 cm and 1 cm. The second layer typically has a reflectivity of about 0.8 to 1 in the visible, near-infrared, and far-infrared regions.

The garment can be configured to cover at least a portion of a wearer's torso. In some implementations, the garment is a vest or a shirt. The garment can be configured to cover a portion of a wearer's leg. In certain implementations, the garment is a pair of pants. The garment can be a head covering (e.g., a hat).

Some implementations include flaps coupled to the second layer. The flaps are configured to cover all or a portion of the openings. The flaps are typically configured to move relative to the second layer, thereby exposing the openings. In some cases, the flaps cover a majority of the surface of the second layer.

The details of one or more embodiments of the subject matter of this disclosure are set forth in the accompanying drawings and the description. Other features, aspects, and advantages of the subject matter will become apparent from the description, the drawings, and the claims.

DETAILED DESCRIPTION

Figure 1:
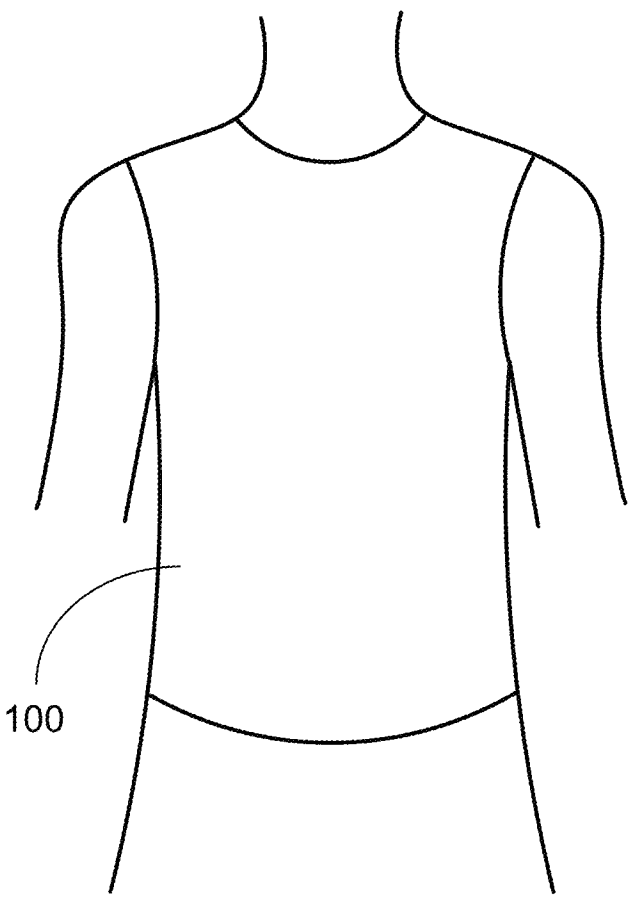
FIG. 1 depicts an individual wearing an evaporative cooling garment.

Exposure of personal cooling garments that rely on evaporation of stored water to sun and/or to even mild air flow dramatically degrades or even negates their cooling capabilities and increases required water use. These effects can be quantified by comparing the performance of a garment that is either shaded from or exposed to sun in various wind speeds using a one-dimensional (1D) resistive network model. FIG. 1 depicts an example of evaporative cooling garment 100 in the form of a vest. However, evaporative cooling garments may be in any size, shape, or configuration configured to contact the body (e.g., skin or hair) of a wearer.

Figure 2:
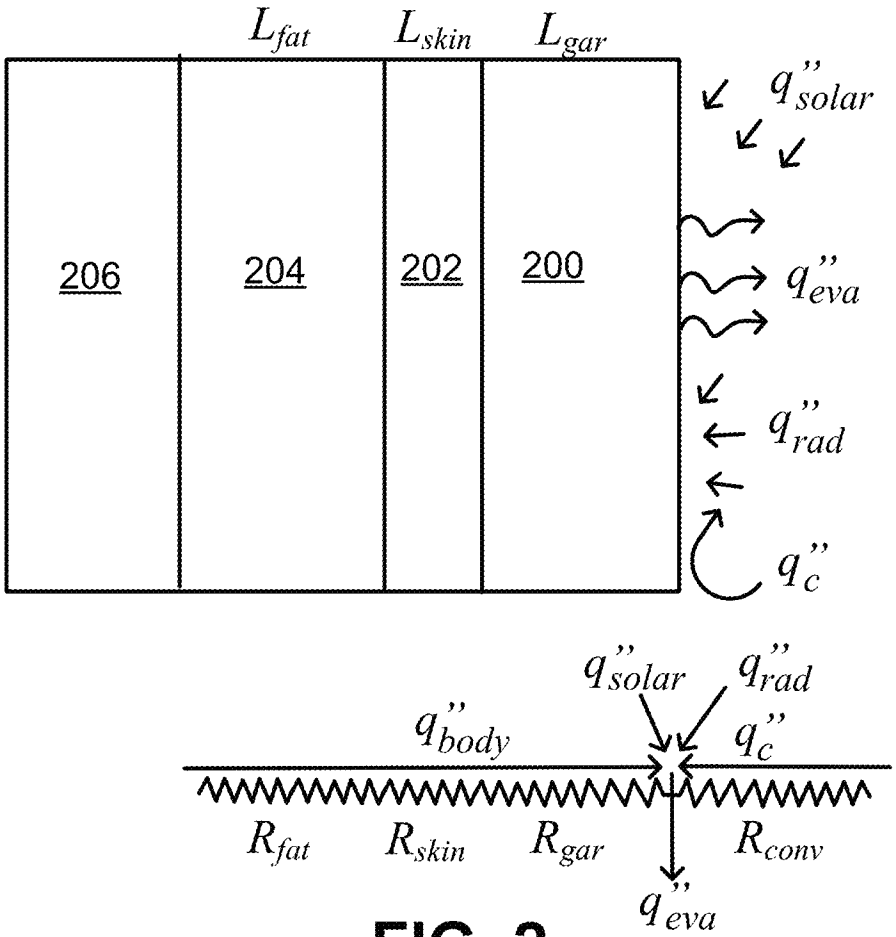
FIG. 2 depicts a cross-sectional view and thermal resistance network showing various heat and mass transfer processes involved in evaporative cooling of a wearer.
Figure 3:
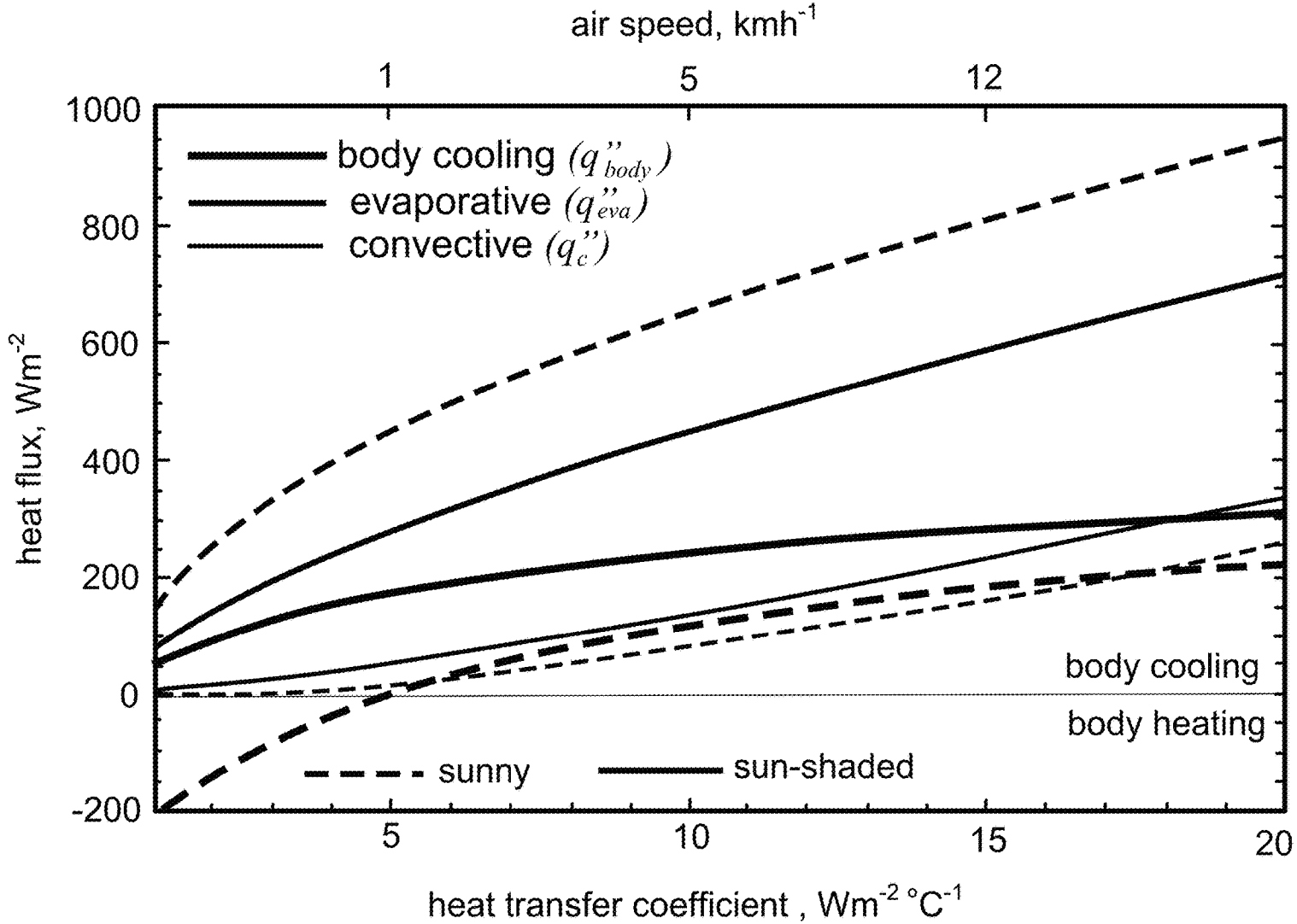
FIG. 3 shows a plot of body cooling, convective loss, and evaporative heat fluxes as a function of heat transfer coefficient (air speed) of an evaporative cooling garment with total, hemispherical absorptivity ($\alpha_T$) of 0.7 that is surrounded by air with a temperature of 40° C. and a fractional relative humidity of 0.1 and is either exposed to or shaded from early afternoon sun.

FIG. 2 depicts a cross-sectional view of a portion of evaporative cooling garment 200 in direct contact with skin 202 of a wearer. Fat 204 and core 206 of the wearer are also depicted. FIG. 2 also depicts a thermal resistance network 208 including the resistance provide by fat ($R_{fat}$), skin ($R_{skin}$), evaporative cooling garment ($R_{gar}$), and convection ($R_{conv}$) and showing various heat and mass transfer processes involved in evaporative cooling of the wearer. With a representative air temperature ($T_{air}$) of 40° C. and a fractional relative humidity ($\phi_{air}$) of 0.1, such evaporative cooling garment 200 is heated by the body ($q''_{body}$) having a core temperature of $T_{core}$, by convection ($q''_{c}$) by solar radiation ($q''_{solar}$), and by far-infrared (FIR) radiation ($q''_{rad}$). Owing at least in part to emissions from the surroundings or the evaporative garment itself, the latter heat source is likely to be present in all cases. The air flow responsible for the convective heating also generally controls the water evaporation rate, which in turn provides the overall latent heat sink for the system ($q''_{eva}$) at $T_{eva}$ By treating the convective heat transfer coefficient ($h_c$) as an input parameter, the steady state one-dimensional equation can be iteratively solved, as shown in FIG. 3.

Demonstrating that air flow is detrimental to effective water use, with $h_c$ greater than about 10 $Wm^{-2}C^{-1}$, the wearer experiences cooling equivalent to evaporation of only one-third to half of the used water, even without exposure to the sun. In other terms, out of 1 $kgm^{-2}$ $hr^{-1}$ of used water, the wearer experiences a cooling equivalent to the evaporation of only 0.33-0.5 $kgm^{-2}$ $hr^{-1}$ (i.e., water use efficiency $\eta = q''_{body}/q''_{eva}$ of 0.3 to 0.5). If the garment is also exposed to solar radiation, $q''_{body}$ decreases markedly despite a significant increase in $q''_{eva}$. Moreover, in natural convection conditions ($h_c$ below 5 $Wm^{-2o}C^{-1}$) the garment wearer is substantially heated ($q''_{body}$ of −100 to −200 $Wm^{-2}$) despite nearly doubling of the evaporation flux over the sun-shaded case ($q''_{eva}$ increases from 250 to 450 $Wm^{-2}$). With a higher air flow, the wearer experiences a moderate level of cooling (i.e., 50 to 100 $Wm^{-2}$), but at the expense of a very low $\eta$ of around 0.2. In some implementations, one or more of these issues can be mitigated by providing the evaporative cooling garment with collapsible perforated reflective sun and wind shading elements.

Evaporative cooling garments described in this disclosure include a water-absorbing first layer and a reflective second layer defining through openings and superimposed over the first layer. The first and second layers are arranged to allow air to flow between the first and second layer under certain conditions. The second layer can be fixed or removably coupled to the first layer at a multiplicity of attachment locations. A "fixed" second layer is sewn or laminated to the first layer at a multiplicity of attachment locations. A "removably coupled" second layer can be coupled to the first layer with fasteners (e.g., snaps, ties, hook-and-loop fasteners).

In some implementations, the first layer includes one or more woven or non-woven natural or synthetic polymer layers selected to hold water in the fibers, between fibers, or in other matrix formats. In one implementation, the first layer includes a superabsorbent polymer between two woven or non-woven natural or synthetic polymer layers. Superabsorbent polymers can soak up an order of magnitude more water than other fabrics. A thickness of the first layer can be in a range between about 0.1 cm and about 1.5 cm. Due at least in part to the protection provided by the second layer, the first layer can have a range of radiative properties.

The second layer can include a material that is highly reflective (reflectivity of 0.8 to 1) in the visible and near and far infrared regions. Such materials can include, but are not limited to, a variety of metalized films and fabrics (e.g., radiative MYLAR® "blanket"), nano-engineered fabrics, or a combination of such. A thickness of the second layer is typically in a range between about 25 μm (e.g., MYLAR®) to about 2 mm or 3 mm (e.g., for a thick reflective fabric). Openings in the second layer correspond to about 10% to about 50% of the area of the second layer. The openings typically have at least one dimension (e.g., a radius, width, length, thickness, or height) of about 0.1 cm to about 2 cm. In some cases, a dimension of each of the openings is comparable to the thickness of the second layer (e.g., circular openings having a diameter of 1 mm in a 1 mm thick second layer). Such a geometry can effectively block a majority of direct solar radiation (assumed to be incident at a moderately high angle corresponding to sunny mid-day conditions).

The second layer is coupled (e.g., removably coupled) proximate the first layer. The evaporative cooling garment is configured such that some or all of the second layer can be in direct contact with the first layer or spaced apart from the first layer to create a ventilation gap between the first layer and the second layer, thereby allowing air to circulate between the first layer and the second layer through the ventilation gap. A dimension of the ventilation gap (e.g., a linear distance between an outer surface of the first layer and an inner surface of the second layer) is typically in a range of about 0.5 cm to about 2 cm, or about 1.5 cm.

In some implementations, an evaporative cooling garment can be configured to cover the back and the chest of a wearer. In some implementations, an evaporative cooling garment can be configured to the neck, head, legs, thighs, or any combination thereof of a wearer.

Figure 4A:
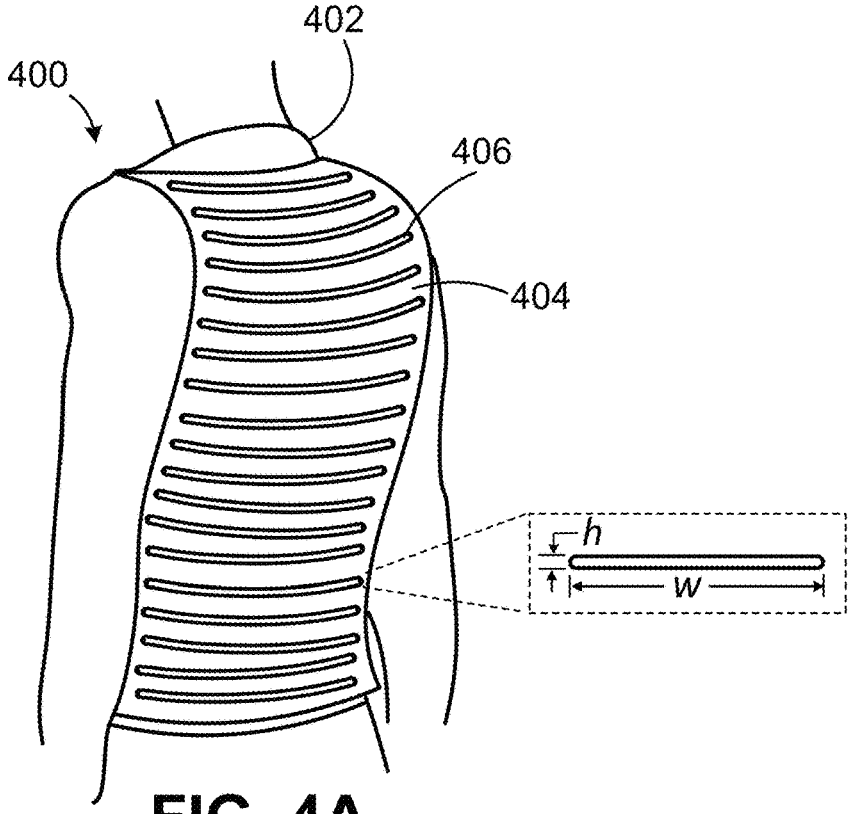
FIG. 4A depicts an evaporative cooling garment.
Figure 4B:
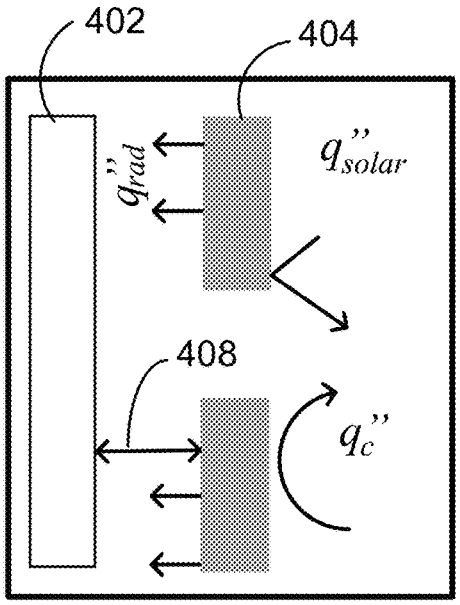
FIGS. 4B and 4C depict a cross section of a portion of the evaporative cooling garment of FIG. 4A under low convection conditions and high convection conditions, respectively.
Figure 4C:
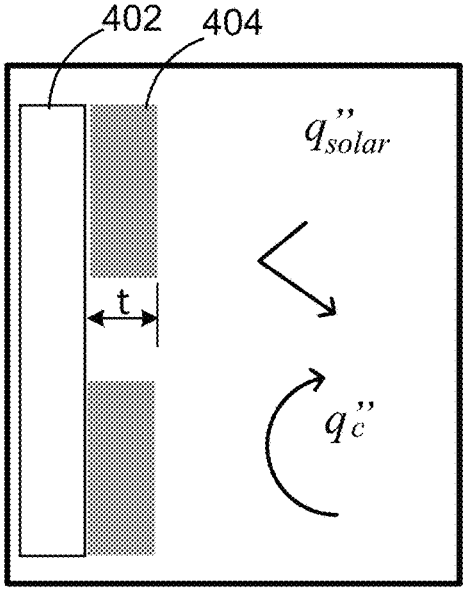

FIG. 4A depicts evaporative cooling garment 400 having a water-absorbing first layer 402 and a reflective second layer 404 superimposed over the first layer. Second layer 404 defines openings 406, such that first layer 402 is visible from the exterior of garment 400 in regions corresponding to the openings. As depicted FIGS. 4A and 4B, openings 406 are linear slits with a width w, a height h, and a thickness t, where thickness t corresponds to a thickness of second layer 404. However, the openings may be of a variety of regular shapes (e.g., circles, ovals, squares) or irregular shapes. Openings 406 are selected expose a portion of the surface area of first layer 402 through second layer 404. Under low convection conditions, first layer 402 and second layer 404 are separated by ventilation gap 408, as depicted in FIG. 4B. Under high convection conditions, second layer 404 lies flat on first layer 402, as depicted in FIG. 4C.

Figure 5A:
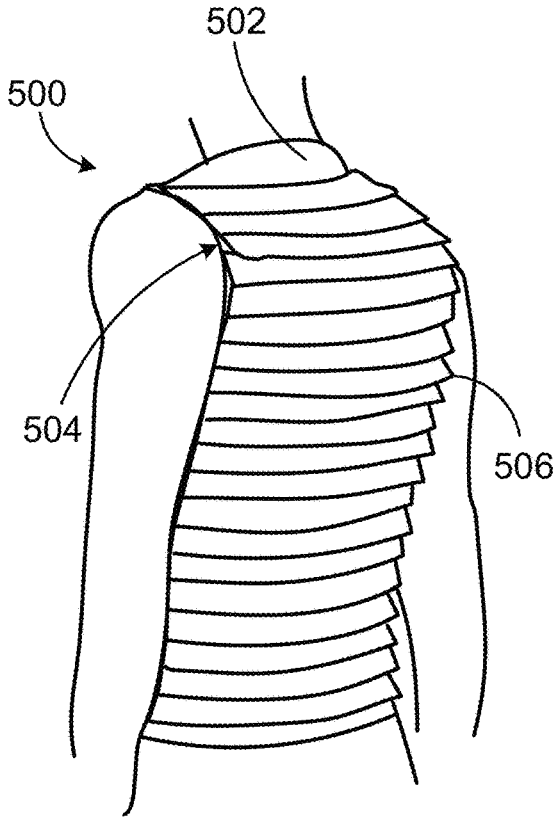
FIG. 5A depicts an evaporative cooling garment.
Figure 5B:
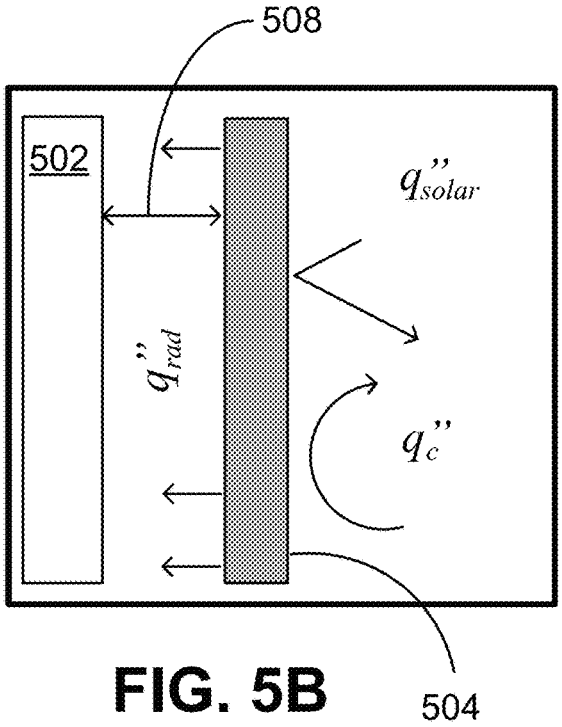
FIG. 5B show a cross-sectional view of a portion of the evaporative cooling garment of FIG. 5A under low convection conditions.

FIG. 5A depicts evaporative cooling garment 500 having water-absorbing first layer 502 and reflective second layer 504 superimposed over the first layer. Second layer 504 includes a multiplicity of shading elements 506. As depicted in FIG. 5A, shading elements 506 are in the form of overlapping strips (flaps) or louvers that overlay openings (e.g., such as openings 406) in second layer 504. Shading elements 506 are arranged such that an angle between a surface of each shading element and first layer 502 (or a base layer of second layer 504, such as first layer 404) can vary between 0 degrees (i.e., shading element 506 lies flat on second layer 504, such that no openings are visible) and about 90 degrees. Shading elements 506 can be coupled to a base of second layer 504 and arranged to open and close freely (e.g., under windy conditions). Under low convection conditions, first layer 502 and second layer 504 are separated by ventilation gap 508, as depicted in FIG. 5B. Under high convection conditions, second layer 504 lies flat on first layer 502.

A multiphysics model can be used to quantify performance of garments covered by louver and slitted second layers that can be thought of as horizontal ruffles and slashes. This model couples conductive, convective, evaporative, and radiative heat transfer with mass transport in natural or forced laminar flow. In the case of natural convection, the model accounts for air buoyancy induced by both temperature and water vapor concentration, which in conditions of interest have a competing effect that can induce flow reversal. Under natural convection conditions, the body cooling and water use efficiency are optimized by introducing a ventilation gap (e.g., 0.5 cm to 2 cm, or about 1.5 cm) between the first layer and the second layer. In forced convection conditions, however, such a gap results in an excessive and highly wind-speed dependent evaporation rate. Based on these results, a slitted second layer design with a collapsible ventilation gap that can provide a nearly sun and wind independent moderate cooling rate. In particular, if the gap is collapsed, the second layer reduces the excessive evaporative rate induced by air motion by reducing the evaporation area. For a high wearer exertion rate, a higher cooling rate can be achieved by maintaining the ventilation gap (e.g., by selecting a material or attachment of the second layer accordingly).

If the wearer is exposed to very low air movement with speed below 0.25 m/s (i.e., the person is stationary, moving slowly, and wind speed is very low), a ventilation gap or spacing can exist between surface of the garment and the inner side of the shading structure. In order to enable development of a moist air flow natural boundary layer, the thickness of this gap is typically at least 1 cm or more. The gap does not necessarily have to be this thick over the entire surface of the garment (e.g., attachment points can be present). In quantitative terms, with a ventilation gap of 1.5 cm, a body cooling flux of 80 to 85 $Wm^{-2}$ with an evaporation flux of 145 to 160 $Wm^{-2}$ (water efficiency use of 0.5 to 0.6) can be obtained with use of a second layer having a thickness of about 1 mm with 100 slits. These values typically do not change much as the number of slits increases from 25 to 100, but can degrade when the number of slits increases to 200. When the openings correspond to about half of the area of the second layer, the degradation of the cooling performance can be due at least in part to higher exposure to far infrared radiation from the environment. For similar reasons, increasing a height of the openings can also degrade the cooling performance of the garment.

If the garment with a perforated second layer (e.g., as in FIG. 4A) and a ventilation gap is exposed to air flow, despite slowing down as it passes through the slits, the air flow parallel to the garment surface increases both body and evaporative fluxes before escaping through ventilation openings.

In one example, for a garment with a first layer, a second layer, and a ventilation gap of about 15 mm, $q''_{body}$ increases from 100 $Wm^{-2}$ to 200 $Wm^{-2}$ and $q''_{eva}$ increases from around 200 to 350 $Wm^{-2}$ when air speed increases from 0.25 to 1 $ms^{-1}$. For a greater air velocity, the body cooling flux saturates around 250 $Wm^{-2}$ to 300 $Wm^{-2}$ while the evaporative flux continues to increase up to around 700 $Wm^{-2}$ with an air speed of 5 $ms^{-1}$. Consequently, the second layer are quite effective in blocking solar radiation because the simulated values are comparable to that obtained for a garment without any shading structures that are not exposed to solar radiation.

If the increase in air flow impacting the garment is caused by movement of the wearer, the increase in the body cooling and evaporative fluxes is likely desirable and needed to compensate for the increased metabolic heat generation. However, if the wearer is more or less stationary and exposed to wind, the additional cooling and associated large water use are likely unnecessary. As such, in response to increased speed of the air moving against the garment, the ventilation gap can collapse. In one example, the mechanism of collapse is aerodynamic. This could include external air flow collapsing a natural fold or inducing a local stretch in the second layer and pressing it against the garment. In other examples, the collapse mechanism includes a switch (e.g., a mechanical switch). In either case, the primary purpose of pressing the second layer against the first layer is to reduce the wet area available for evaporation. The level of this reduction is directly proportional to the resulting heat flux. Adjusting the number of slits between 50 and 100 enables (or open area of 12.5 to 25% of the first layer) marked decrease of $q''_{eva}$ values while maintaining moderate values of $q''_{body}$. In particular, for a second layer with 50 slits and wind speeds increasing from 1.5 to 5 $ms^{-1}$, $q''_{body}$ will increase from 77.5 to 95 $Wm^{-2}$ while $q''_{eva}$ will increase from 160 to 230 $Wm^{-2}$ ($\eta$ decreases from 0.48 to 0.41). In turn, increasing to 100 slits at the same wind speeds, $q''_{body}$ increases from 120 to 150 $Wm^{-2}$ while q" eva increases from 245 to 345 $Wm^{-2}$ ($\eta$ decreases from 0.49 to 0.43).

Altogether, simulation results indicate that an evaporative garment covered by a highly reflective second layer with about 10% open area and a ventilation gap of around 15 mm that collapses when exposed to air flow can provide the wearer with nearly sun and wind independent cooling flux between 80 to 95 $Wm^{-2}$ with an evaporation flux between 160 to 230 $Wm^{-2}$. If the wearer desires a moderately higher cooling flux, increasing the open area to 25% enables increase in $q''_{body}$ from 75 to 150 $Wm^{-2}$, but at a cost of a higher $q''_{eva}$ from 175 to 345 $Wm^{-2}$ (values represent range from natural convection to forced convection with air speed of 5 $ms^{-1}$). In forced convection conditions, doubling the number of slits results in, albeit more wind-speed dependent, 50% increase in the wearer cooling as well as evaporative flux. In all these scenarios, a moderate $\eta$ of 0.4 to 0.5 is achieved. This again highlights that both of these second layers provide a performance improvement over an unshaded garment that is exposed to sun. To reinforce this point, in stagnant and sunny condition, a wearer of a garment without a second layer experiences a heating flux of about 100 $Wm^{-2}$ despite an evaporation flux of over 300 $Wm^{-2}$. The wearer can experience cooling if exposed to air movement but at a cost of a dramatically increased water consumption rate (e.g., at 1.5 $ms^{-1}$ and 5 $ms^{-1}$ $q''_{body}$ is 70 and 200 $Wm^{-2}$ while $q''_{eva}$ is 650 and 920 $Wm^{-2}$ (thus $\eta$ of 0.1 to 0.2)). That is, to achieve the $q''_{eva}$ of 650 and 920 $Wm^{-2}$, a garment without a second layer would need to store 1 to 1.4 $kgm^{-2}$ to provide an hour of cooling in the sun. By introducing the collapsible slitted second layers, the mass of the stored water required to provide comparable cooling flux for one hour can be reduced to 0.25 to 0.35 $kgm^{-2}$ for a second layer with 10% open area and 0.25 to 0.5 $kgm^{-2}$ for a second layer with 25% open area. Consequently, the garment with rationally designed, reflective slitted second layers can either be much lighter or provide cooling for significantly extended period of time, nearly independent of sun and wind exposure.

Although this disclosure contains many specific embodiment details, these should not be construed as limitations on the scope of the subject matter or on the scope of what may be claimed, but rather as descriptions of features that may be specific to particular embodiments. Certain features that are described in this disclosure in the context of separate embodiments can also be implemented, in combination, in a single embodiment. Conversely, various features that are described in the context of a single embodiment can also be implemented in multiple embodiments, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular embodiments of the subject matter have been described. Other embodiments, alterations, and permutations of the described embodiments are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example embodiments do not define or constrain this disclosure. Other changes, substitutions, and alterations are also possible without departing from the spirit and scope of this disclosure.

What is claimed is:

1. An evaporative cooling garment comprising:

a first layer, wherein the first layer is configured to absorb a quantity of water;

a second layer superimposed over the first layer, wherein the second layer comprises a reflective material having a reflectivity of about 0.8 to 1 in the visible, near-infrared, and far-infrared regions and, defines openings, wherein the openings in the second layer comprise about 10% to about 50% of the surface area defined by a perimeter of the second layer, wherein the first layer is visible from an exterior of the garment through the openings in the second layer, and the garment defines a collapsible gap between an inner surface of the second layer and an outer surface of the first layer, wherein the first layer has a thickness between about 0.1 cm and about 1.5 cm, and wherein the second layer has a thickness between about 0.1 cm and 1 cm.

2. The evaporative cooling garment of claim 1, wherein the openings are rectangular or circular.

3. The evaporative cooling garment of claim 1, wherein the collapsible gap, when not collapsed, is in a range between about 0.1 cm and about 2 cm.

4. The evaporative cooling garment of claim 1, wherein when the collapsible gap is collapsed, the inner surface of the second layer and the outer surface of the first layer are in direct contact.

5. The evaporative cooling garment of claim 1, wherein the first layer is a composite material.

6. The evaporative cooling garment of claim 1, wherein the first layer comprises a superabsorbent polymer.

7. The evaporative cooling garment of claim 1, wherein the garment is configured to cover at least a portion of a wearer's torso.

8. The evaporative cooling garment of claim 7, wherein the garment is a vest or a shirt.

9. The evaporative cooling garment of claim 1, wherein the garment is configured to cover at least a portion of a wearer's leg.

10. The evaporative cooling garment of claim 1, wherein the garment is configured to cover at least a portion of a wearer's head.

11. The evaporative cooling garment of claim 1, further comprising flaps coupled to the second layer, wherein the flaps are configured to cover the openings.

12. The evaporative cooling garment of claim 11, wherein the flaps are further configured to move relative to the second layer, thereby exposing the openings.

13. The evaporative cooling garment of claim 11, wherein the flaps cover a majority of the surface of the second layer.

14. The evaporative cooling garment of claim 1, wherein the second layer is removably coupled to the first layer.

15. The evaporative cooling garment of claim 14, wherein the openings are slits.

16. The evaporative cooling garment of claim 15, wherein the second layer has a thickness of about 1 mm with 100 slits.

* * * * *